US007406844B1

(12) United States Patent
Haimm

(10) Patent No.: US 7,406,844 B1
(45) Date of Patent: Aug. 5, 2008

(54) GOLF CLUB LOCK APPARATUS

(76) Inventor: Michael Haimm, 11407 Knot Way, Cooper City, FL (US) 33026

( * ) Notice: Subject to any disclaimer, the term of this patent is extended or adjusted under 35 U.S.C. 154(b) by 0 days.

(21) Appl. No.: 11/334,846

(22) Filed: Jan. 19, 2006

Related U.S. Application Data

(63) Continuation-in-part of application No. 10/966,604, filed on Oct. 15, 2004.

(51) Int. Cl.
*E05B 69/00* (2006.01)

(52) U.S. Cl. ..... 70/58; 70/14; 70/18; 70/59

(58) Field of Classification Search ..... 70/14, 70/18, 19, 21–30, 49, 233, 53–61, 43–48, 70/DIG. 63; 206/315.2, 315.6; 211/4, 7, 211/8, 70.2, 70.5
See application file for complete search history.

(56) References Cited

U.S. PATENT DOCUMENTS

| | | | | | |
|---|---|---|---|---|---|
| 1,477,777 | A * | 12/1923 | Shek | 70/38 C |
| 2,738,113 | A * | 3/1956 | Sigler | 294/165 |
| 3,738,132 | A * | 6/1973 | Nagel | 70/49 |
| 3,830,416 | A * | 8/1974 | Smedley | 294/165 |
| 3,838,585 | A * | 10/1974 | Foote | 70/18 |
| 4,570,465 | A * | 2/1986 | Bennett | 70/18 |
| 4,719,773 | A * | 1/1988 | Alberts | 70/18 |
| 4,863,019 | A | 9/1989 | Lewis et al. | 206/315.3 |
| 4,873,848 | A * | 10/1989 | Honeyman, III | 70/14 |
| 4,918,951 | A * | 4/1990 | Kavizky | 70/53 |
| 4,956,982 | A * | 9/1990 | Valley | 70/59 |
| 5,216,903 | A * | 6/1993 | Chen | 70/55 |
| 5,297,681 | A * | 3/1994 | Gourley | 206/503 |
| 5,351,507 | A * | 10/1994 | Derman | 70/18 |
| D366,202 | S | 1/1996 | Murphy | |
| 5,590,772 | A | 1/1997 | Schuhlen et al. | 206/315.3 |
| 6,196,385 | B1 | 3/2001 | Thompson et al. | 206/315.6 |
| 6,360,747 | B1 * | 3/2002 | Velarde et al. | 128/869 |
| 6,381,998 | B1 | 5/2002 | Good | 70/58 |
| 6,679,086 | B1 * | 1/2004 | Hart, Jr. | 70/56 |
| 6,705,134 | B2 * | 3/2004 | Miranda | 70/52 |
| 6,742,366 | B1 * | 6/2004 | Lai | 70/58 |
| 6,843,080 | B1 * | 1/2005 | Yu | 70/21 |

* cited by examiner

*Primary Examiner*—Suzanne Dino Barrett
(74) *Attorney, Agent, or Firm*—Laurence A. Greenberg; Werner H. Stemer; Ralph E. Locher

(57) ABSTRACT

A golf club lock apparatus for securing at least one golf club having a club shaft with a narrow segment and two shaft ends and a club head secured at one shaft end includes an interconnection line; two club shaft engaging mechanisms secured in spaced apart relation to the interconnection line, each shaft engaging mechanism having a locking and retaining structure for lockingly retaining at least one club shaft. Each shaft engaging mechanism preferably is a padlock having a lock mechanism case and a lock U-bolt having two U-bolt legs, one U-bolt leg extending slidably into the lock mechanism case and the other U-bolt leg lockably slidable into and out of the lock mechanism case and sized to closely fit around a narrow segment of a golf club shaft, so that the padlock must be opened to release the club. Each U-bolt preferably includes two U-bolt legs which are separate members interconnected by a hinge structure.

17 Claims, 5 Drawing Sheets

GOLF CLUB LOCK APPARATUS

This application is a continuation-in-part of application Ser. No. 10/966,604 filed on Oct. 15, 2004.

BACKGROUND OF THE INVENTION

1. Field of the Invention

The present invention relates generally to the field of equipment for the game of golf. More specifically the present invention relates to a golf club lock apparatus for golf clubs having a club shaft including a club handle and having a club head, the lock apparatus including two club shaft engaging mechanisms secured to opposing ends of an interconnection line, each shaft engaging mechanism having means for lockingly retaining at least one club shaft.

Each shaft engaging mechanism preferably is a padlock having a lock mechanism case and a lock U-bolt having U-bolt legs, the padlocks being constructed and operate in the same way that prior art padlocks are constructed and operate, with the following exceptions. First the U-bolts are sized so that the U-bolt legs closely fit around a narrow segment of a standard club shaft. Each lock U-bolt has a space between U-bolt legs which closely fits around the narrowest part of the club shaft which typically is just above the club head. As a result the club cannot be slid longitudinally out of the lock and the lock must be opened to laterally release the club. It is preferred that the U-bolt legs be separate members interconnected with a hinge pin so that they can be pivoted apart to release club shafts after the padlock is opened, and then pivoted toward each other to secure club shafts between them. A leaf spring is preferably secured to the U-bolt adjacent to the pivot pin to bias the U-bolt legs apart so that the U-bolt springs open to release or accept one or more club shafts upon opening of the padlock.

To use the lock apparatus, the interconnection line is fitted through an existing ring found on the lip of a typical golf bag, the lock U-bolts are fitted around one or more club shafts and the padlocks are then locked. On the relatively few existing golf bags not having a bag ring, the line can be fitted through the bag handle. As a result the apparatus and locked clubs can be secured to virtually any existing golf bag without modification. In addition, the interconnection line can be fitted through or around many objects other than a golf bag.

2. Description of the Prior Art

There have long been golf club locks for securing golf clubs against theft, especially while the clubs are in a bag on a golf course. Golf club security has become more important in recent years with the development of highly sophisticated and expensive clubs, and often it can be all to easy for someone wandering through a golf course to simply snatch such a club out of a bag while the owner is playing. Prior club locks generally have been cumbersome, costly, inconvenient to use or lacking in versatility.

Schuhlen, et al., U.S. Pat. No. 5,590,772, issued on Jan. 7, 1997, reveals a golf club look. Schuhlen, et al., includes a series of shackles very similar to padlocks which receive and lockingly retain golf club shafts, the shackles being retained in lock retaining box. A cable connects the retaining box to a golf bag and an anchor structure such as a pole.

Murphy, U.S. Patent Number Des. 366,202, issued on Jan. 16, 1996, reveals a locking device for golf clubs. Murphy includes an array of interconnected U-shaped club shaft receiving structures and what appears to be a slidable locking panel which fits through slots in the receiving structures to retain the club shafts against removal. The locking panel has a protruding end with a cable passing port for connecting the device to a golf bag.

Good, U.S. Pat. No. 6,381,998 B1, issued on May 7, 2002, discloses a golf bag security device. Good includes a club retaining assembly in the form of a perforated circular panel which is mounted across the open top of a golf bag so that club shafts are passed through the individual perforations, and includes an actuating mechanism operatively associated with the club retaining assembly. A security mechanism having several fingers locks the clubs within the club retaining assembly.

Lewis, et al., U.S. Pat. No. 4,863,019, issued on Sep. 5, 1989, teaches a golf bag lock. Lewis, et al., includes two arm members which extend diametrically across the open top of a golf club bag and are mounted at one end in a guide structure fastened to the bag and pivotally connected to a hinge structure at the other end also fastened to the bag. The arms can be pivoted toward each other in the guide structure to lockingly grip shafts of clubs and can be pivoted apart to free the clubs.

Thompson, et al., U.S. Pat. No. 6,196,385, issued on Mar. 6, 2001, discloses a golf club locking device. Thompson, et al., includes a locking main member for affixing across the open top of a golf bag having mouth-like openings for receiving club shafts. A locking member is coupled to the main member and slides relative to the main member to a club locking position and to a club releasing position.

It is thus an object of the present invention to provide a golf club lock which is versatile in that it can secure golf clubs to a golf bag ring or handle, a post or other structure, and can secure clubs of more than one shaft diameter, and can secure items other than golf clubs.

It is another object of the present invention to provide such a golf club lock which is compact and light in weight to be easy to carry and store.

It is still another object of the present invention to provide such a golf club lock which can display logos and other forms of advertising.

It is finally an object of the present invention to provide such a golf club lock which is easy to use and inexpensive to manufacture.

SUMMARY OF THE INVENTION

The present invention accomplishes the above-stated objectives, as well as others, as may be determined by a fair reading and interpretation of the entire specification.

A golf club lock apparatus is provided for securing at least one golf club having a club shaft with a narrow segment and two shaft ends and a club head secured at one shaft end, including an interconnection line; two club shaft engaging mechanisms secured in spaced apart relation to the interconnection line, each shaft engaging mechanism having a locking and retaining structure for lockingly retaining at least one club shaft.

Each shaft engaging mechanism preferably is a padlock having a lock mechanism case and a lock U-bolt having two U-bolt legs, one U-bolt leg extending slidably into the lock mechanism case and the other U-bolt leg lockably slidable into and out of the lock mechanism case and sized to closely fit around a narrow segment of a golf club shaft, so that the club cannot be slid out of the lock after the U-bolt is locked to the lock mechanism case and so that the padlock must be opened to release the club. Each U-bolt preferably includes two U-bolt legs which are separate members interconnected by a hinge structure; so that the U-bolt legs can be pivoted apart to release the at least one club shaft after the padlock is opened, and then pivoted toward each other to secure the at least one club shaft between the U-bolt legs. The golf club lock apparatus preferably additionally includes a spacer sleeve removably fitted around at least one of the U-bolt legs of at one of the padlocks for providing a combined leg and spacer sleeve diameter creating a distance between the U-bolt legs sufficient to cause the U-bolt legs to fit closely around a narrow portion of the at least one golf club shaft, the spacer sleeve being removable from the U-bolt leg to narrow the diameter of the given the U-bolt leg and thereby widen the distance between the U-bolt legs of the at least one padlock.

The interconnection line preferably is one of a cable and a chain. The interconnecting line preferably is covered with plastic.

The golf club lock apparatus preferably additionally includes a looping ring connected to the interconnection line and sized in diameter so that one of the shaft engaging mechanisms can fit through the looping ring. The at least one padlock preferably is a combination lock. The combination lock preferably is a three wheel combination lock.

A golf club lock apparatus is further provided, including a golf club having a club shaft having two shaft ends and a club head secured at one shaft end; an interconnection line; two club shaft engaging mechanisms secured in spaced apart relation to the interconnection line, each shaft engaging mechanism having a locking and retaining structure for lockingly retaining the club shaft.

A golf club lock apparatus is still further provided, including a golf club having a club shaft having two shaft ends and a club head secured at one the shaft end; a golf club bag having a bag ring; an interconnection line fitted through the bag ring; two club shaft engaging mechanisms secured in spaced apart relation to the interconnection line, each shaft engaging mechanism having a locking and retaining structure for lockingly retaining the club shaft.

A golf club lock apparatus is yet further provided for securing at least one golf club having a club shaft with a narrow segment and a club head, including an interconnection line; at least one club shaft engaging mechanism secured to the interconnection line, the shaft engaging mechanism having a locking and retaining structure for lockingly retaining at least one club shaft.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
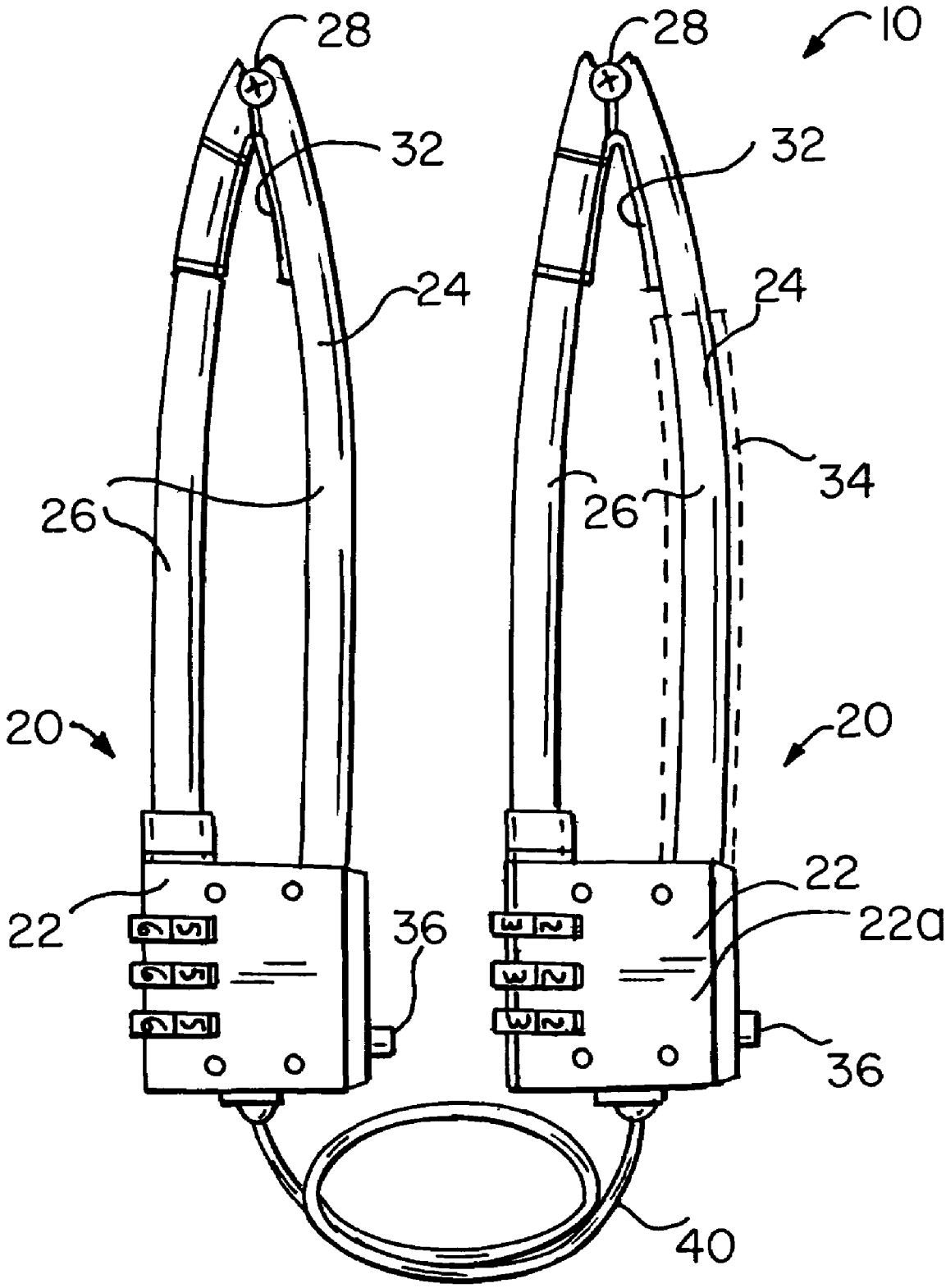
FIG. 1 is a side view of the preferred embodiment of the apparatus, showing three wheel combination locks as shaft engaging mechanisms. The lock U-bolt is shown with the leg biasing leaf spring adjacent the hinge pin, and one U-bolt leg is fitted with a spacer sleeve. The preferred push button lock release is also shown.
Figure 2:
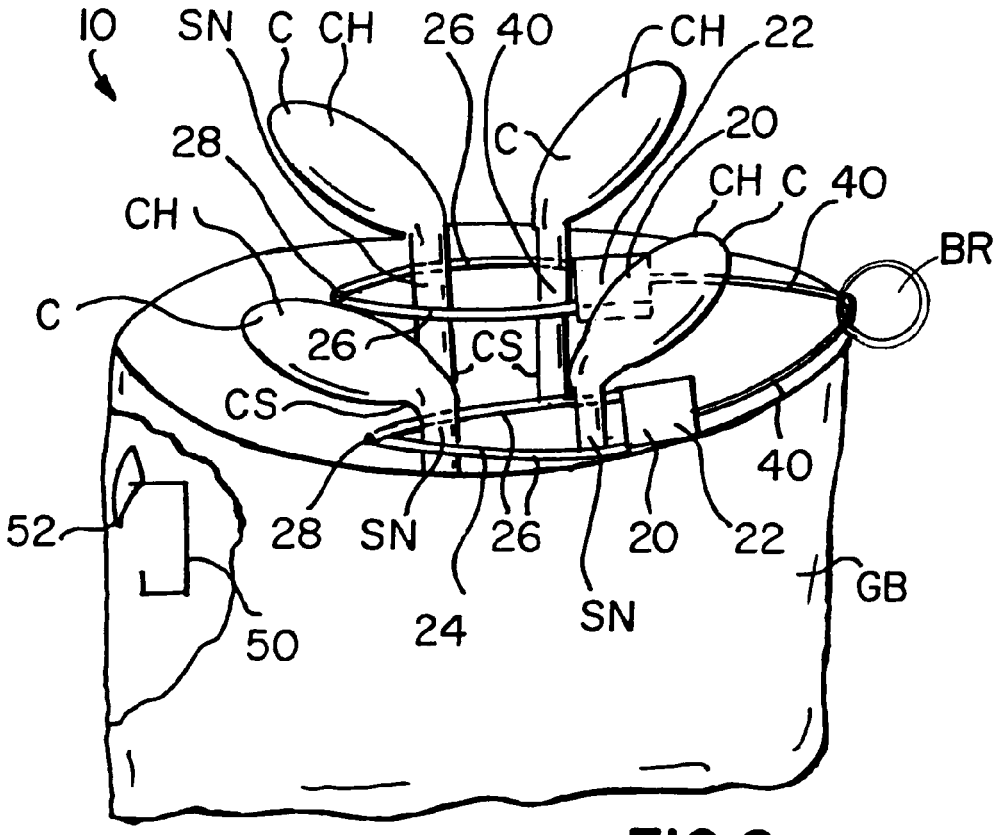
FIG. 2 is a perspective view of the upper end of a golf bag with the apparatus of FIG. 1 fitted around and securing several clubs, and the interconnection line fitted through the bag ring.
Figure 3:
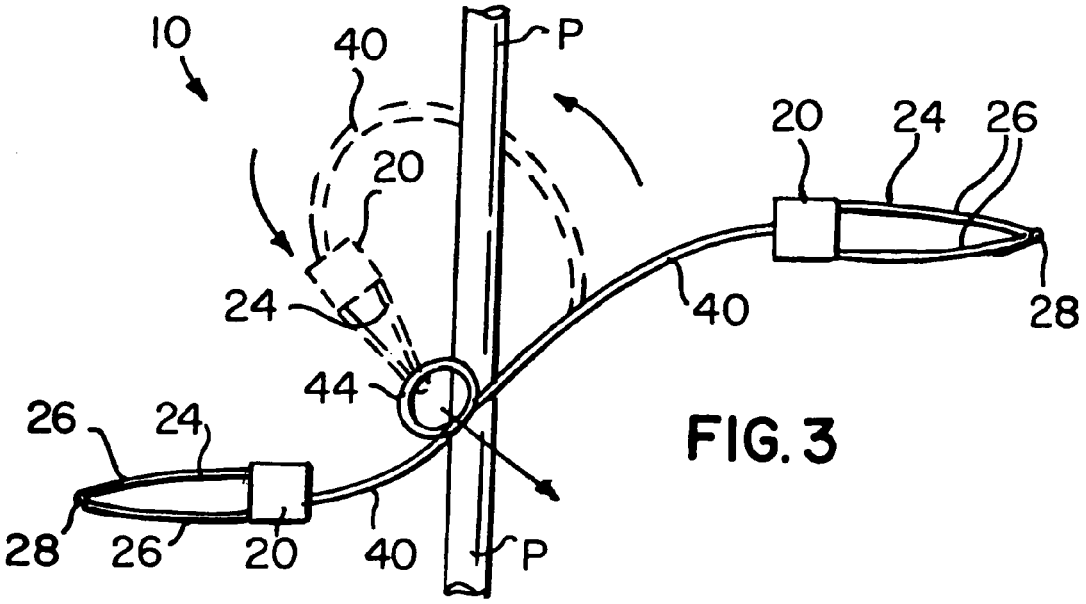
FIG. 3 is a perspective view of the apparatus of FIG. 1 with the optional looping ring added, positioned adjacent a post. One end of the apparatus is shown in broken lines being looped around the post so that one of the padlocks is being fitted through the looping ring.
Figure 4:
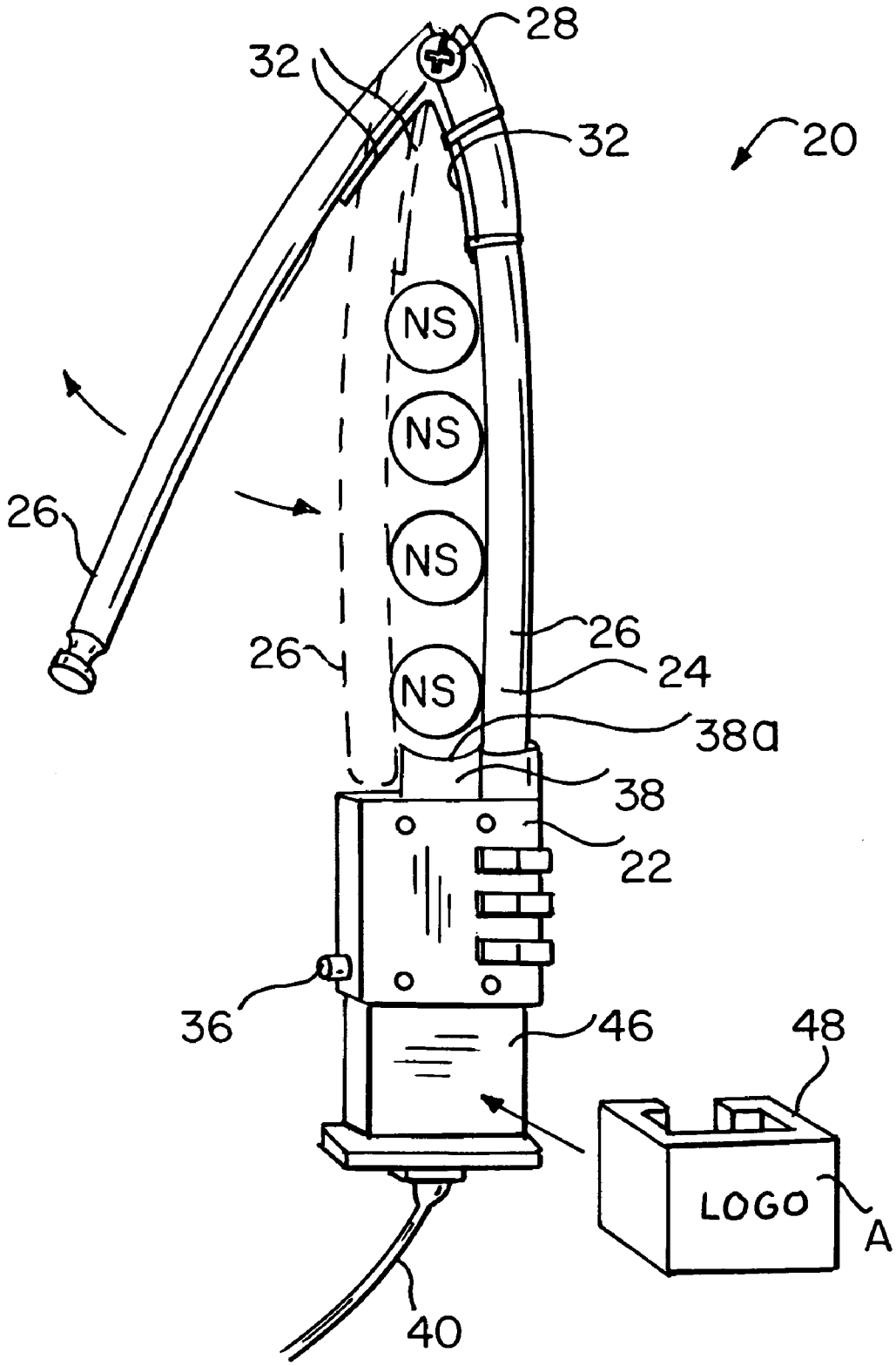
FIG. 4 is a side view of one padlock having the optional feature of a pivot stop for a U-bolt leg on the mechanism case and an extended case body having a circumferential channel for removably receiving an advertising display clip.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1-9, a golf club lock apparatus 10 is disclosed for golf clubs C having a club shaft CS including a club grip and having a club head CH, the lock apparatus 10 including two club shaft engaging mechanisms 20 secured to opposing ends of an interconnection line 40, each shaft engaging mechanism 20 having means for lockingly retaining at least one club shaft CS.

Each shaft engaging mechanism preferably is a padlock 20 having a lock mechanism case 22 and a lock U-bolt 24 having U-bolt legs 26, and is sized to fit through a standard golf bag ring BR or golf bag handle BH. The padlocks 20 are constructed and operate in the same way that prior art padlocks are constructed and operate, with one U-bolt leg 26 extending slidably into the lock mechanism case 22 and the other U-bolt leg 26 lockably slidable into and out of the lock mechanism case 22, with the following exceptions. First the U-bolts 24 are sized so that the U-bolt legs 26 closely fit around a narrow segment NS of a standard club shaft CS. Each lock U-bolt 24 has a space between U-bolt legs 26 which closely fits around the narrowest part of the club shaft CS which typically is just above the club head CH. As a result the club C cannot be slid longitudinally out of the lock 20 and the lock 20 must be opened to laterally release the club C.

An optional although normally unnecessary feature of each padlock 20 is a lock mechanism construction causing the U-bolt leg 26 lockably slidable out of the lock mechanism case 22 to slide out of the lock mechanism case 22 a distance sufficient to pass the diameter of a given club shaft narrow segment NS. In most instances this feature is not necessary because, once the padlock 10 is open, the U-bolt can be pivoted relative to the case 22 to permit insertion of club shafts CS, or because the U-bolt has the hinged construction described in the following paragraph.

It is preferred that the U-bolt legs 26 be separate members interconnected with a hinge pin 28 so that they can be pivoted apart to release club shafts CS after the padlock 20 is opened, and then pivoted toward each other to secure club shafts CS between them. A leaf spring 32 is preferably secured to the U-bolt 24 adjacent to the hinge pin 28 to bias the U-bolt legs 26 apart so that the U-bolt 24 springs open to release or accept one or more club shafts CS upon opening of the padlock 20. A pivot stop 38 preferably is provided on the mechanism case 22 between the U-bolt legs 26 for stopping the pivoting U-bolt leg 26 at a position directly over the corresponding receiving port (not shown) in the mechanism case 22. The outward surface 38*a* of the pivot stop 38 directed toward the lock U-bolt 24 preferably is curved to receive the side surface of a club shaft CS. A U-bolt biasing mechanism preferably is provided which is operated by depressing a lock opening button 36 on lock mechanism case 22 to spring the U-bolt 24 outwardly from the lock mechanism case 22 after the lock mechanism is released through setting the correct combination or turning a key to open the padlock 20.

A plastic spacer sleeve 34, which also may be characterized as a collar, preferably is removably fitted around one or both U-bolt legs 26 to provide a combined leg 26 and spacer sleeve 34 diameter creating a distance between the U-bolt legs 26 sufficient to cause the legs 26 to fit closely around the narrow portion of most golf clubs CS just above the club head CH when the legs 26 are pivoted into position for locking. This construction permits the apparatus 10 to be altered to engagingly fit wider club shafts CS such as those made by WILSON™ by opening the lock 20 and removing the spacer sleeve 34 to narrow the diameter of the given U-bolt leg 26, and thus widen the distance between the legs 26.

The flexible interconnection line 40 preferably is a cable or chain on which the shaft engaging mechanisms 20 are secured in spaced apart relation, and preferably is coated in plastic or is fit within a plastic cover tube 42 to prevent the line 40 from scratching a golf bag GB or any other item it may touch. A looping ring 44 preferably is connected to the interconnection line 40 and optionally is sized so that one of the shaft engaging mechanisms, such as a padlock 20, can fit through the looping ring 44. This feature permits the interconnection line 40 to be looped around an object such as a post P and one of the padlocks 20 locked directly to, or fitted through, the looping ring 44. One or more club shafts CS can be secured in the padlock U-bolts 24 while the apparatus 10 is in this looped configuration. See FIG. 3.

An alternative to the looping ring 44 is a looping plate 70 having a line port 72 through which the interconnection line 40 passes, and a lock port 74 sized to pass a padlock 20 but not to pass a golf club C. The looping plate 70 preferably is formed of steel or other strong material. The looping plate 70 is preferred over the looping ring 44 because plate 70 is more durable and the size of the line port 72 can be selected to cause the plate 70 to engage and retain its position along the interconnection line 40. See FIG. 9. Plate 70 preferably is too wide to fit through a golf bag ring BR or bag handle BH to prevent apparatus 10 separation from a golf bag GB.

The lock mechanism case 22 is optionally made longer or wider than a conventional lock mechanism case to increase the area of the opposing broad faces 22*a* of the case for display of a company or product name, a logo, apparatus 10 purchaser name or initials, or other advertising indicia A. Mechanism case 22 preferably has a circumferential clip channel 46 recessed into its surface and a resilient advertising display clip 48 with a C-shaped cross-section sized to resiliently pivot open and fit closely and engagingly around the circumferential clip channel 46. See FIG. 4. Display clip 48 preferably is formed of a durable and resilient plastic. Advertising indicia A is printed or embossed into the outer surface of a display clip 48 and the display clip 48 fit around the lock mechanism case 22. The display clip 48 can be replaced with another such display clip 48 marked with different advertising indicia A. A three wheel combination lock 20 is preferred, although key locks and other types of combination locks are considered suitable.

To use lock apparatus 10, the interconnection line 40 is fitted through an existing ring BR found on the lip of a typical golf bag GB, the lock U-bolts 24 are fitted around one or more club shafts CS and the padlocks 20 are then locked. On the relatively few existing golf bags GB not having a bag ring BR, the line 40 can be fitted through the bag handle BH. As a result the apparatus 10 and locked clubs C can be secured to virtually any existing golf bag GB without modification. In addition, the interconnection line 40 can be fitted through or around many objects other than a golf bag GB.

Figure 5:
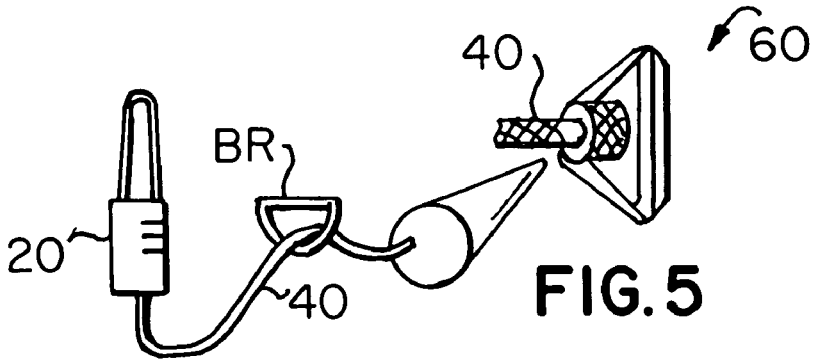
FIG. 5 is an example of a stop structure in the form of a triangular metal plate.
Figure 6:
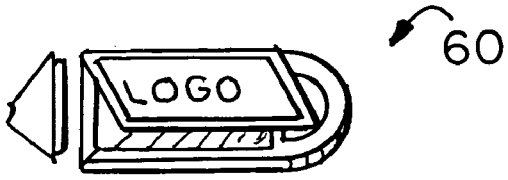
FIG. 6 is another example of a stop structure in the form of a storage box such as for retaining Tees.
Figure 7:
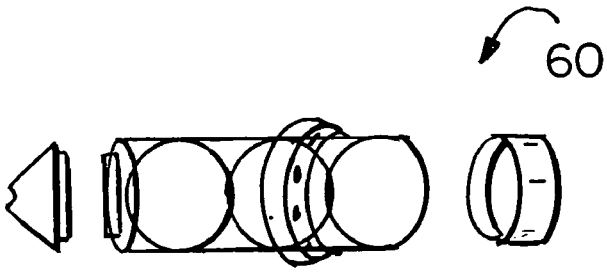
FIG. 7 is still another example of a stop structure in the form of a golf ball containing tube having a Tee mounting collar around its circumference with Tee receiving ports.
Figure 8:
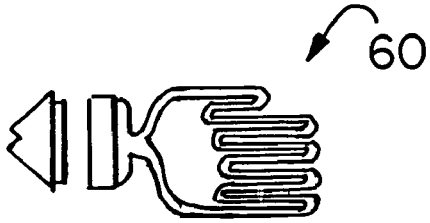
FIG. 8 is yet another example of a stop structure in the form of a golf glove holder having the general shape and size of a human hand.
Figure 9:
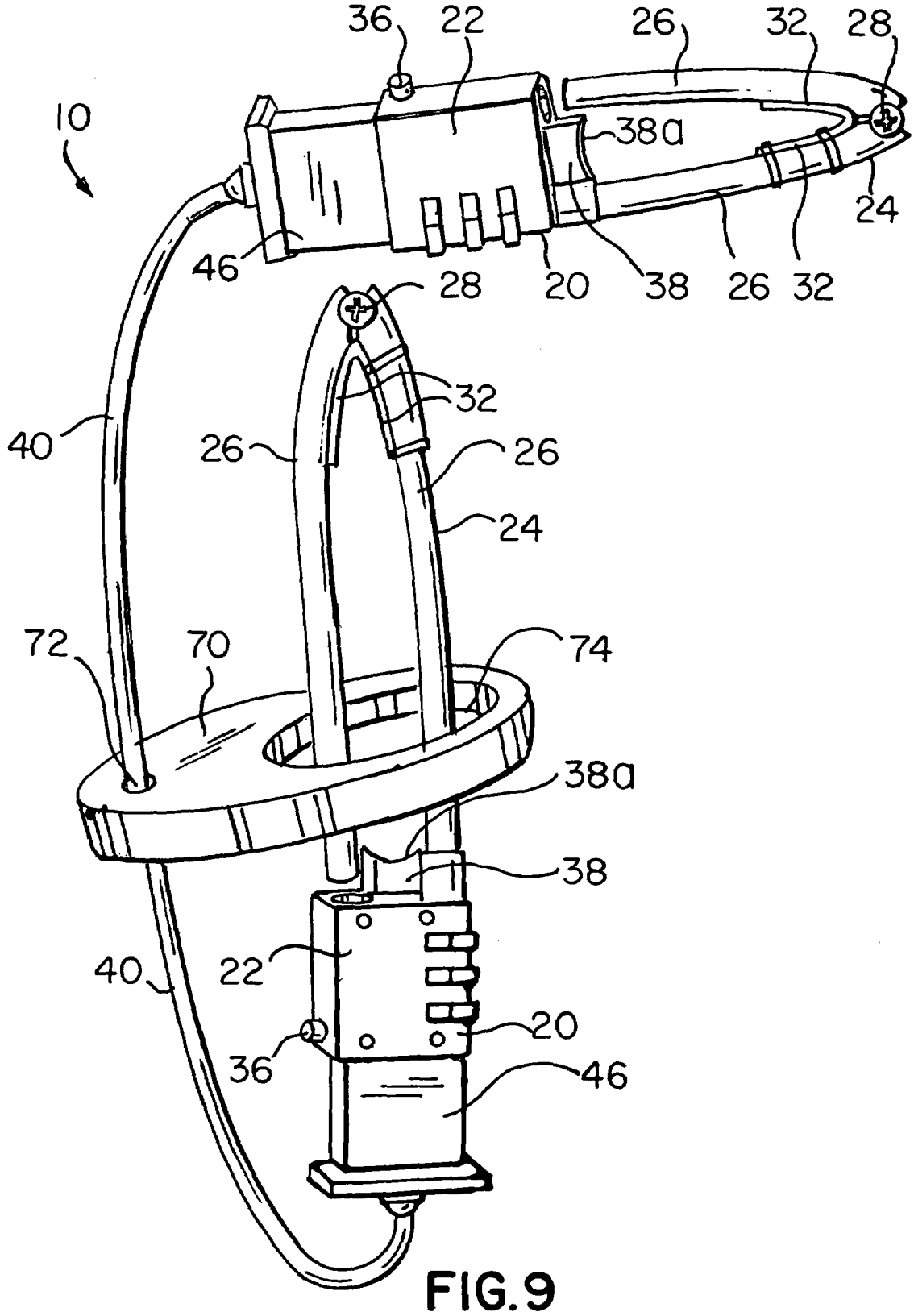
FIG. 9 is a perspective view of the apparatus of FIG. 1 with the optional looping plate added, with one end of the apparatus being looped and one of the padlocks being fitted through the lock port in the looping plate.

One of the padlocks 20 is optionally replaced with a stop structure 60 having a size too large to fit through golf bag ring BR or bag handle BH. As a result the single padlock 20 on this version of apparatus 10 is fitted through the bag ring BR or bag handle BH and fastened around one or more club shafts CS. Neither the clubs C locked in the padlock 20 nor the stop structure 60 can be pulled through the bag ring BR or bag handle BH, so that the apparatus 10 and clubs C can be removed from the golf bag GB until the padlock 20 is unlocked and the clubs C removed. The stop structure 60 may be a simple metal plate as shown in FIG. 5, or a storage box for Tees as shown in FIG. 6, or golf ball containing tube having a Tee mounting collar around its circumference as shown in FIG. 7 or a golf glove holder as shown in FIG. 8, or may take many other forms.

The apparatus 10 preferably is painted in a bright neon color to be conspicuous and thus deter would-be thieves. An apparatus retaining hanger 50 preferably is provided and has a hanger base panel 52 which is secured to the inside wall of a golf bag on which the apparatus 10 may be hung when not in use.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A combination golf club and golf club lock apparatus, the combination comprising:

golf clubs each having a club shaft with a narrow segment and two shaft ends and a club head secured at one said shaft end;

a flexible interconnection line; and two independent and separately movable club shaft engaging mechanisms secured to and yet movable relative to each other in spaced apart relation only by said flexible interconnection line, each said shaft engaging mechanism having a locking and retaining device lockingly retaining the narrow segment of said club shaft of a respective different one of said golf clubs.

2. The combination of claim 1, wherein each said shaft engaging mechanism is a padlock having a lock mechanism case and a lock U-bolt having two U-bolt legs, one said U-bolt leg extending slidably into said lock mechanism case and the other said U-bolt leg lockably slidable into and out of said lock mechanism case and sized to closely fit around a narrow segment of a golf club shaft, such that the club cannot be slid out of the lock after the U-bolt is locked to the lock mechanism case and such that the padlock must be opened to release the club.

3. The combination of claim 2, wherein each said U-bolt comprises U-bolt legs which are separate members interconnected by a hinge;

such that said U-bolt legs can be pivoted apart to release the at least one club shaft after the padlock is opened, and then pivoted toward each other to secure the at least one club shaft between said U-bolt legs.

4. The combination of claim 2, additionally comprising a spacer sleeve removably fitted around at least one of said U-bolt legs of at least one said padlock for providing a combined leg and spacer sleeve diameter creating a distance between said U-bolt legs sufficient to cause said U-bolt legs to fit closely around a narrow portion of the at least one golf club shaft, said spacer sleeve being removable from the U-bolt leg to narrow the diameter of the given said U-bolt leg and thereby widen the distance between said U-bolt legs of said at least one padlock.

5. The combination of claim 1, wherein said interconnection line is one of a cable and a chain.

6. The combination of claim 1, wherein said interconnecting line is covered with plastic.

7. The combination of claim 1, additionally comprising a looping ring connected to said interconnection line and sized in diameter such that one of said shaft engaging mechanisms can fit through said looping ring.

8. The combination of claim 1, additionally comprising a looping plate having a line port through which said interconnection line passes and a lock port separate from and not in communication with said line port, said lock port sized in diameter such that one said shaft engaging mechanism can fit through said lock port and such that a golf club cannot pass through said lock port.

9. The combination of claim 2, wherein said lock mechanism case comprises advertising indicia.

10. The combination of claim 2, wherein said lock mechanism case comprises a circumferential clip channel and a resilient display clip removably fit into and around said circumferential clip channel, said display clip displaying advertising indicia.

11. The combination of claim 2 wherein at least one said padlock is a combination lock.

12. The combination of claim 10, wherein said combination lock is a three wheel combination lock.

13. The combination of claim 1, wherein said golf clubs lockingly retained by said engaging mechanisms are parts of different sets of golf clubs.

14. The combination of claim 1, wherein each of said engaging mechanisms receive the narrow segment of at least two of said golf clubs.

15. A combination golf club, golf club bag and golf club lock apparatus, the combination comprising:

golf clubs each having a club shaft with a narrow segment and two shaft ends and a club head secured at one said shaft end;

a golf club bag having one of a bag ring and a bag handle;

a flexible interconnection line fitted through one of said bag ring and bag handle; and two independent and separately movable club shaft engaging mechanisms secured to and yet movable relative to each other in spaced apart relation only by said flexible interconnection line, each said shaft engaging mechanism having a locking and retaining device lockingly retaining the narrow segment of said club shaft of a respective different one of said golf clubs.

16. The combination of claim 15, wherein said golf clubs lockingly retained by said engaging mechanisms are parts of different sets of golf clubs.

17. The combination of claim 15, wherein each of said engaging mechanisms receive the narrow segment of at least two of said golf clubs.

* * * * *